US005296847A

United States Patent [19]

Takeda et al.

[11] Patent Number: 5,296,847

[45] Date of Patent: Mar. 22, 1994

[54] METHOD OF DRIVING DISPLAY UNIT

[75] Inventors: Etsuya Takeda, Suita; Yutaka Nanno, Amagasaki; Seiichi Nagata, Sakai, all of Japan

[73] Assignee: Matsushita Electric Industrial Co. Ltd., Osaka, Japan

[21] Appl. No.: 902,564

[22] Filed: Jun. 22, 1992

Related U.S. Application Data

[63] Continuation of Ser. No. 448,662, Dec. 11, 1989, abandoned.

[30] Foreign Application Priority Data

Dec. 12, 1988 [JP] Japan ..... 63-313456

[51] Int. Cl.[5] ..... G09G 3/36

[52] U.S. Cl. ..... 345/92; 345/208; 345/58

[58] Field of Search ..... 340/805, 784; 359/58, 359/59

[56] References Cited

U.S. PATENT DOCUMENTS

| | | | |
|---|---|---|---|
| 4,386,352 | 5/1983 | Nonomura et al. | 340/784 |
| 4,626,841 | 12/1986 | Togashi | 340/784 |
| 4,675,667 | 6/1987 | Nakamura et al. . | |
| 4,710,768 | 12/1987 | Takeda et al. | 340/784 |
| 4,728,172 | 3/1988 | Cannella | 350/339 R |
| 4,906,984 | 3/1990 | Takeda et al. | 340/784 |
| 4,909,602 | 3/1990 | Kaneko et al. | 350/332 |
| 4,955,697 | 9/1990 | Tsukada et al. | 350/333 |

FOREIGN PATENT DOCUMENTS

| | | |
|---|---|---|
| 0112700 | 7/1984 | European Pat. Off. . |
| 60-3698 | 1/1985 | Japan . |
| 60-151615 | 8/1985 | Japan . |
| 60-156095 | 8/1985 | Japan . |
| 61-256325 | 11/1986 | Japan . |
| 61-275822 | 12/1986 | Japan . |
| 61-275823 | 12/1986 | Japan . |
| 61-275824 | 12/1986 | Japan . |
| 2188471 | 9/1987 | United Kingdom . |

OTHER PUBLICATIONS

"1988 International Display Research Conference" (IDRC), Eliminating Crosstalk in Thin Film Transistor/Liquid Crystal Displays, W. E. Howard, P. M. Alt, R. L. Wisnieff, IBM Research Division, pp. 230–235.

"Euro Display", A New Active Matrix LCD Architecture for Larger Size Flat TV Displays, K. Oki, et al., Fujitsu Lab. Ltd., Atsugi, Japan, 1987, pp. 55–58.

"Japan Display", Compensation of the Display Electrode Voltage Distortion, T. Yanagisawa, K. Kasahara, M. Kajimura, Electron Device Enginnering Laboratory, Toshiba Corp., pp. 192–195.

"Euro Display", Compensative Addressing for Switching Distortion in A-Si TETLCD, Kouji Suzuki, Toshiba R&D Center, Japan, 1987, pp. 107–110.

*Primary Examiner*—Alvin E. Oberley
*Assistant Examiner*—S. Saras
*Attorney, Agent, or Firm*—Stevens, Davis, Miller & Mosher

[57] ABSTRACT

A method of driving a display unit having matrix-arranged pixel electrodes each connected via a capacitor to a first line, each pixel electrode being connected to a switching element which is electrically connected to an image signal line and scan signal line, and display material held between the pixel electrode and opposing electrode and being AC driven, wherein an image signal voltage is transmitted to the pixel electrode during an on-period of the switching element, and a modulating signal with its voltage reversing alternately for each field is applied to the first line during an off-period of the switching element, thereby changing the potential of the pixel electrode so that the changed potential is superposed upon, or cancelled out from, the image signal voltage, the resultant voltage being applied across the display material.

14 Claims, 17 Drawing Sheets

METHOD OF DRIVING DISPLAY UNIT

This application is a continuation of application Ser. No. 07/448,662, filed Dec. 11, 1989 (abandoned).

BACKGROUND OF THE INVENTION

1. Field of the Invention

The present invention relates to a method of AC driving a display unit made of display material such as liquid crystal by using an active matrix constructed of switching elements such as thin film transistors (hereinafter called TFT) and pixel electrodes, and also to a method of setting its drive voltages, respectively aiming at a) reduction of drive power, b) improvement on display quality, and c) improvement on drive reliability.

2. Description of Prior Art

The display quality of active matrix display units has been considerably improved nowadays, to the degree that it stands unrivaled by CRTs. However, first, from the view point of image quality, it cannot be said that active matrix display units are as good as CRTs with respect to flickers; brightness change on a screen in a vertical direction, i.e., brightness inclination; image memory phenomenon such that after a fixed image is displayed, it remains on the screen as if it has been burnt on it; gradation display performance; and the like. There have not been reported as yet techniques to radically solve the adverse effects of DC voltage and crosstalk which are unavoidably generated by parasitic capacitors within a display unit.

The following techniques are known for the improvement of flickers. There is disclosed in Japanese Patent Laid-open Publications JP-A-60-151615, JP-A-61-256325, and JP-A-61-275823, the technique that the polarities of signal voltages are reversed alternately for each display field. There is disclosed in Japanese Patent Laid-open Publications JP-A-60-3698, JP-A-60-156095, and JP-A-61-275822, the technique that the polarities of signal voltages are reversed alternately for each scan line. There is disclosed in Japanese Patent Laid-open Publication JP-A-61-275824 the technique that the polarities of signal voltages are reversed alternately both for each display field and for each scan line.

With the above techniques, no compensation is provided for the DC voltage (described below) which is unavoidably generated due to the dielectric anisotropy of display material such as liquid crystal, due to parasitic capacitors in a display unit, or due to other causes, and flickers are conventionally intended to be reduced not for each pixel but apparently and collectively for all pixels.

There is also known a technique which intends to reduce crosstalk in a particular active matrix arrangement, as disclosed in "Euro Display" by K. Oki et al., '87, p 55. In this technique, a reference signal is added before a scan signal to thereby reduce an image signal amplitude and hence crosstalk. Another known crosstalk reduction technique is disclosed in "International Display Research Conference (I.D.R.C.)" by W.E. Howard et al, '88, p. 230. This technique intends to compensate for crosstalk voltage after the application of an image signal. The above two techniques do not compensate for the DC voltage of liquid crystal as will be described later.

There is not known a technique which intends to improve the brightness inclination and gradation display performance per se.

There are known the following two documents which disclose the technique of compensating for the DC voltage unavoidably generated in a display unit due to dielectric anisotropy of liquid crystal, of radically reducing flicker, and of improving drive reliability. The first document "JAPAN DISPLAY" by T. Yanagisawa, et al, '86, p. 192 intends to compensate for the DC voltage by using an image signal voltage (Vsig) having different positive and negative amplitudes relative to a base or center voltage (Vc). The second document "Euro Display" by K. Suzuki, '87, p. 107 intends to compensate for the DC voltage by adding a negative signal (Ve) after a scan signal.

The third problem is that a DC potential difference occurs between the average potential at an image signal line and that at a pixel electrode because a scan signal adversely effects the pixel electrode potential via a parasitic capacitor Cgd between the gate and drain of a TFT. If the potentials at various circuit portions of a display unit are set so as to make zero the average DC potential difference between the pixel electrodes and opposing electrode during the AC drive of liquid crystal, there is unavoidably generated the DC potential difference between the image signal line and opposing electrode. This DC potential difference results in a serious defect such as the image memory phenomenon. There is not known, however, a method of compensating for such DC potential difference.

The fourth problem is that contrary to the characteristic feature of small drive power of a liquid crystal display unit, in an actual case, the conventional drive circuit processes analog signals by using a great number of signal output circuits so that it consumes a large power (several hundreds mW) which is not suitable for operating it with a battery or the like in a portable apparatus. It has therefore been desired to develop a method of driving a display unit with low power consumption.

SUMMARY OF THE INVENTION

The present invention aims at solving the above problems to thereby improve the display quality and drive reliability and reduce the drive power of a display unit.

The above objects of the present invention are achieved by the provision of a display unit having matrix-arranged pixel electrodes each connected via a capacitor to a first line, each pixel electrode being connected to a switching element which is electrically connected to an image signal line and scan signal line, and display material held between the pixel electrode and opposing electrode and being AC driven, wherein an image signal voltage is transmitted to said pixel electrode during an on-period of said switching element, and a modulating signal with its voltage reversing alternately for each field is applied to said first line during an off-period of said switching element, thereby changing the potential of said pixel electrode so that said changed potential is superposed upon, or cancelled out from, said image signal voltage, the resultant image signal voltage being applied across said display material.

With such arrangement, if the switching element is a TFT (thin film transistor), the potential change of the scan signal Vg gives the image signal a potential change Cgd x Vg in the negative direction through electrostatic induction of the gate-drain capacitor Cgd. According to this invention, the modulating signal whose amplitude changes between Ve(+) and Ve(−) alternately for each field is applied to the pixel electrode via the storage capacitor Cs so that a potential changes Cs x Ve(+)

in the positive direction and Cs x Ve(−) in the negative direction are generated at the pixel electrode, and superposed upon the potential change Cgd x Vg. These potential changes can be set so as to satisfy the following relationship:

$$(CsVe(+) + CgdVg)/Ct = (CsVe(-) - CgdVg)/Ct = \Delta V^*$$

If the ΔV* value is set larger than or equal to the threshold voltage of the liquid crystal, this capacitor coupled potential is supplied as a fraction of the liquid crystal drive voltage so that the amplitude of an image signal to be supplied from the image signal driver can be reduced correspondingly to reduce the drive power.

It is therefore possible to compensate for at least a fraction of the DC components caused by the dielectric anisotropy of liquid crystal and caused by electrostatic induction by the scan signal via the gate-drain capacitor. Consequently, the causes of generating the flicker-/image memory phenomenon and the like can be eliminated to allow a high quality display and a high drive reliability of the display unit.

DESCRIPTION OF THE REFERRED EMBODIMENTS

The theoretical background of this invention will be described in the following.

Figure 1:
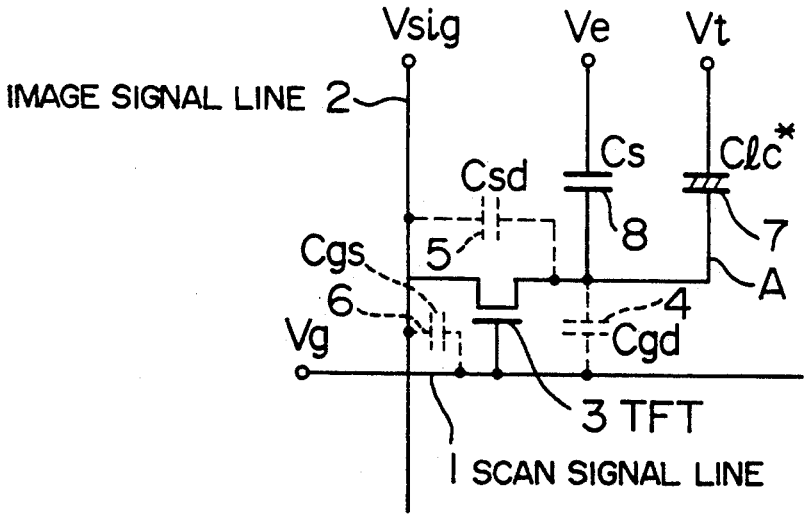
FIG. 1 is an equivalent circuit of a single pixel used for explaining the principle of this invention.

The electric equivalent circuit of a display element of a TFT active matrix drive LCD is shown in FIG. 1. Each display element includes a TFT 3 at the intersection between a scan signal line 1 and image signal line 2. A TFT has as its parasitic capacitors a gate-drain capacitor Cgd 4, source-drain capacitor Csd 5 and gate-source capacitor Cgs 6. In addition, there are intentionally provided a liquid crystal capacitor Clc* 7 and storage capacitor Cs 8.

As the drive voltages for the display element, a scan signal Vg is applied to the scan signal line 1, an image signal voltage Vsig to the image signal line 2, a modulating signal reversing its polarities Ve(+) and Ve(−) alternately for each field to one electrode of the storage capacitor Cs, and a voltage constant for all fields to the opposing electrode of the liquid crystal capacitor Clc*. The influence of the drive voltages is reflected upon the pixel electrode (at point A in FIG. 1) through electrostatic induction via the above-described parasitic capacitors and intentionally provided capacitors.

Figure 2:
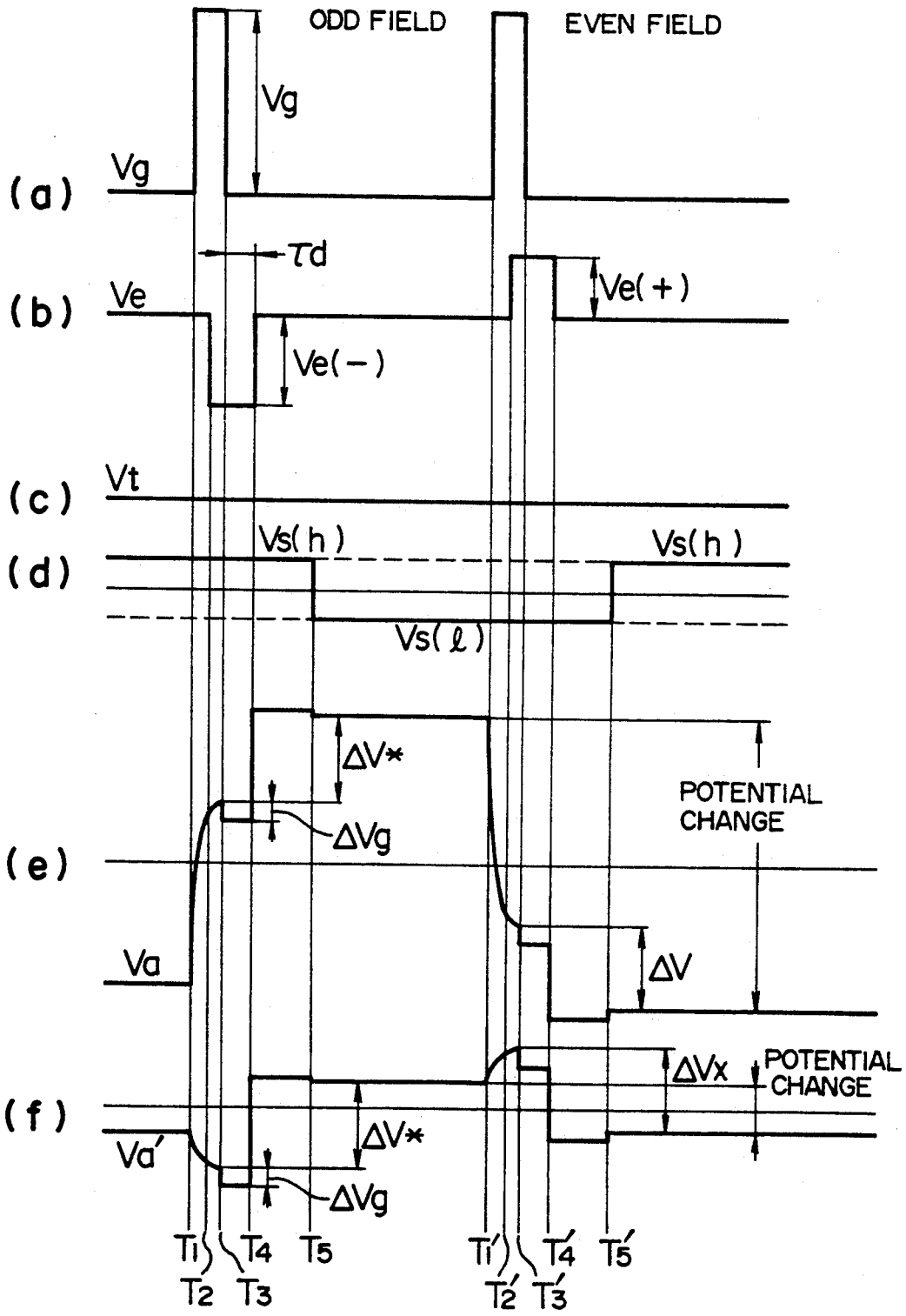
FIGS. 2(*a*)-(*f*) and 4(*a*)-(*f*) show voltage waveforms applied to a single pixel shown in FIG. 1.

Upon application of the voltages Vg, Ve(+), Ve(−), Vt and Vsig for n-th scan line shown at (a) to (d) in FIG. 2 to the corresponding terminals shown in FIG. 1, the potential change ΔV* at the pixel electrode caused by the capacitive coupling is given by the following equations (1) and (2) respectively for the even and odd fields (excepting the potential change by the voltage from the image signal line upon turning-on of the TFT):

$$\Delta V^{*+} = (CsVe(+) + CgdVg \pm CsdVsig)/Ct \quad (1)$$

$$\Delta V^{*-} = (CsVe(-) - CgdVg \pm CsdVsig)/Ct \quad (2)$$

$$Ct = Cs + Cgd + Csd + Clc^* = Cp + Csd + Clc^* = \Sigma C$$

The second terms of the equations (1) and (2) represent a potential change induced to the pixel electrode by the scan signal Vg via the parasitic capacitor Cgd. The first terms represent the effect of the first modulating voltage. The third terms represent a potential change induced to the pixel electrode by the image signal voltage via the parasitic capacitor. Clc* represents the capacitance of the liquid crystal which capacitance changes with the dielectric anisotropy as the orientation state of the liquid crystal changes with the amplitude of the signal voltage Vsig. ΔV* accordingly changes with the magnitude of the liquid crystal capacitance which may take a large value Clc(h) or small value Clc(l). The gate-source capacitor Cgs can be neglected because this capacitor does not directly influence the pixel electrode potential and also because both the scan signal line and image signal line are driven with low impedance power sources.

If the potential changes ΔV*+ and ΔV*− at the even and odd fields are made equal, it is possible to compensate for the DC potential change given to the pixel electrode by the scan signal Vg via the parasitic capacitor Cgd. The DC potential is therefore not applied across the liquid crystal, thereby enabling symmetrical Ac drive. In other words, the following equation can be satisfied:

$$(CsVe(+)+CgdVg-CsdVsig) = (CsVe(-)-CgdVg-CsdVsig) \quad (3)$$

Since the image signal voltage Vsig is reversed alternately for each scan line, the third term CsdVs is cancelled out at each field. Therefore, the equation (3) is simplified to the following equation:

$$(CsVe(+)+CgdVg)=(CsVe(-)-CgdVg) \quad (4)$$

The first point to be noted is that the potential $\Delta V^*$ induced to the pixel electrode relative to the opposing electrode can be made equal for even and odd fields, irrespective of the liquid crystal capacitance.

The second point is that the term Clc* does not appear in the equations (3) and (4). In other words, if the liquid crystal is driven under the conditions satisfying the equations (3) and (4), the effects of the dielectric anisotropy of liquid crystal can be eliminated so that the DC voltage caused by Clc* is not generated within the display unit.

The third point is that under the conditions satisfying the equations (3) and (4), it is possible to cancel out the DC voltage induced across the image signal line and pixel electrode by the scan signal Vg through the parasitic capacitor Cgd. According to the drive method of this invention, a signal is used which changes its polarity alternately for each field, between negative and positive relative to the opposing electrode potential, so that as viewed from the odd and even two fields, DC voltage field is not generated among the pixel electrode, signal electrode and opposing electrode. This drive method which generates no DC voltage across the liquid crystal, allows improved reliability.

The fourth point to be noticed further is that the conditional equations (3) and (4) include two voltage parameters Ve(+) and Ve(−) which can be arbitrarily set on the side of the display unit. By properly setting the Ve(+) and Ve(−) values of the equations (3) and (4), the value of the potential change $\Delta V^*$ at the pixel electrode can be arbitrarily set. If the value $\Delta V^*$ is set larger than or equal to the threshold voltage of the liquid crystal, the signal Vsig of a smaller amplitude can be used. With a smaller amplitude signal Vsig, the amplitude of signals outputted from the image signal drive circuit dealing with analog signals can be made small so that the power consumption of the drive circuit can be reduced in proportion to the square of the amplitude. In case of a color display, the power consumed by a chroma IC also handling analog signals can be reduced. Since this IC is turned on and off by the digital modulating signals Ve(+) and Ve(−), all the drive circuits constructed of complementary MOSICs can also be operated with reduced drive power. The values of the above-described capacitors and voltage parameters used in the embodiment display units to be described later are as follows:

Cs=0.68pF, Clc(h)=0.226pF,

Clc(l)=0.130pF, Cgd=0.059pF,

Csd=0.001pF, Vg=15.5V, Ve(+)=−2.5V,

Ve(−)=+4.9V, Vt=0V, Vsig=±2.0V.

Upon taking into consideration of the above parameters, the third term of the equation (3) can be neglected and the equation (4) is changed to the equation (4*a*) which is given by:

$$(Ve(-)-Ve(+))=2CgdVg/Cs \quad (4a)$$

Waveforms shown at (e) and (f) in FIG. 2 represent the potential change at the pixel electrode (point A in FIG. 1) when the drive signal Vg, Vsig, and modulating signal Ve are applied to the electrode terminals shown in FIG. 1. Specifically, in the case where Vsig takes a phase as shown by a solid line at (d) in FIG. 1 relative to the modulating signal Ve, upon application of the scan signal Vg at T=T1 at the odd field, TFT becomes conductive and the potential Va at point A is charged to the potential Vs(h). The signal Ve changes in the negative direction by the amount Ve(−) at T =T2 before TFT turns off (preferably at the time between T1 and T2 during the conductive state of TFT). When the scan signal falls, this potential change of Vg appears as a potential change $\Delta Vg$ at point A via the capacitor Cgd. When the signal Ve changes in the positive direction by the amount Ve(−), this causes the potential change at point A as shown at (d) in FIG. 2. When the signal Vsig changes from Vs(h) to Vs(l) at time T=T5, this causes the corresponding potential change as shown at (d) in FIG. 2. The potential change caused by these capacitive couplings is represented by $\Delta V^*$.

Thereafter at the even field, upon application of the scan signal, TFT charges point A to the low level Vs(l) of the signal Vsig. Upon turning-off of TFT, the potential change caused by the capacitive couplings appears as $\Delta V^*$ in the similar manner described above. As appreciated, in the case where Vsig and Ve take the above phase relationship, i.e., in the case where at the time of turning-off of TFT, Vsig takes a high level when VE takes a low level, and vice versa, the potential change Veff at the pixel electrode relative to the image signal amplitude Vsigpp, upon a change of the Ve after turning-on of Ve, becomes approximately $2\Delta V^*+2Vsigpp$ as shown at (e) in FIG. 2, Vsig and $\Delta V^*$ being superposed one upon the other. In this case, the amplitude of an image signal from the image signal output IC can be reduced by $2\Delta V^*$ (hereinafter this phase relationship between Ve and Vsig is called the opposite phase).

On the contrary, in the case where the modulating signal Ve and image signal Vsig take a phase relationship as shown at the broken line at (d) in FIG. 2 (hereinafter this phase relationship is called the same phase), the potential change at the pixel electrode becomes approximately $2\Delta V^*-2Vsigpp$, Vsig and $\Delta V^*$ being cancelled out partially relative to each other.

Figure 3:
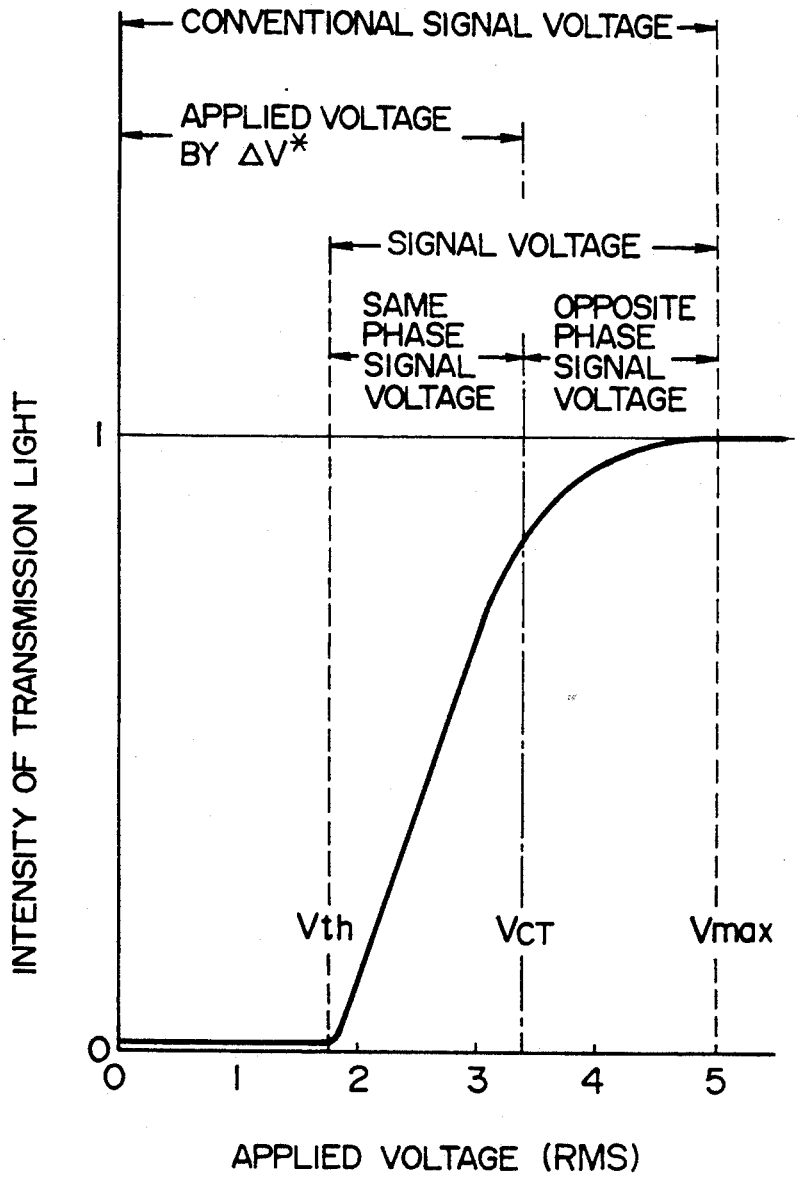
FIG. 3 is a graph showing the relationship between a transmission light intensity in liquid crystal and an applied voltage, and the effect of potential change generated by voltage signals according to this invention.

FIG. 3 shows the relationship between a voltage applied to a liquid crystal and the transmission light intensity, and the voltage range for controlling the transmitted light with $\Delta V^*$ and Vsig. The intensity of a transmitted light at liquid crystal changes within the voltage range from the threshold voltage Vth of liquid crystal to its saturation voltage Vmax. If $\Delta V^*$ is set larger than or equal to Vth without amplitude and phase control of signal voltages, the maximum necessary image signal voltage becomes (Vmax−Vth). If on the other hand $\Delta V^*$ is set at Vct with the amplitude and phase control of signal voltages, the maximum necessary image signal voltage can be reduced to about (Vmax−Vth)/2, thereby achieving one of the above-described objects of this invention which is to make smaller the image signal amplitude.

Figure 4:
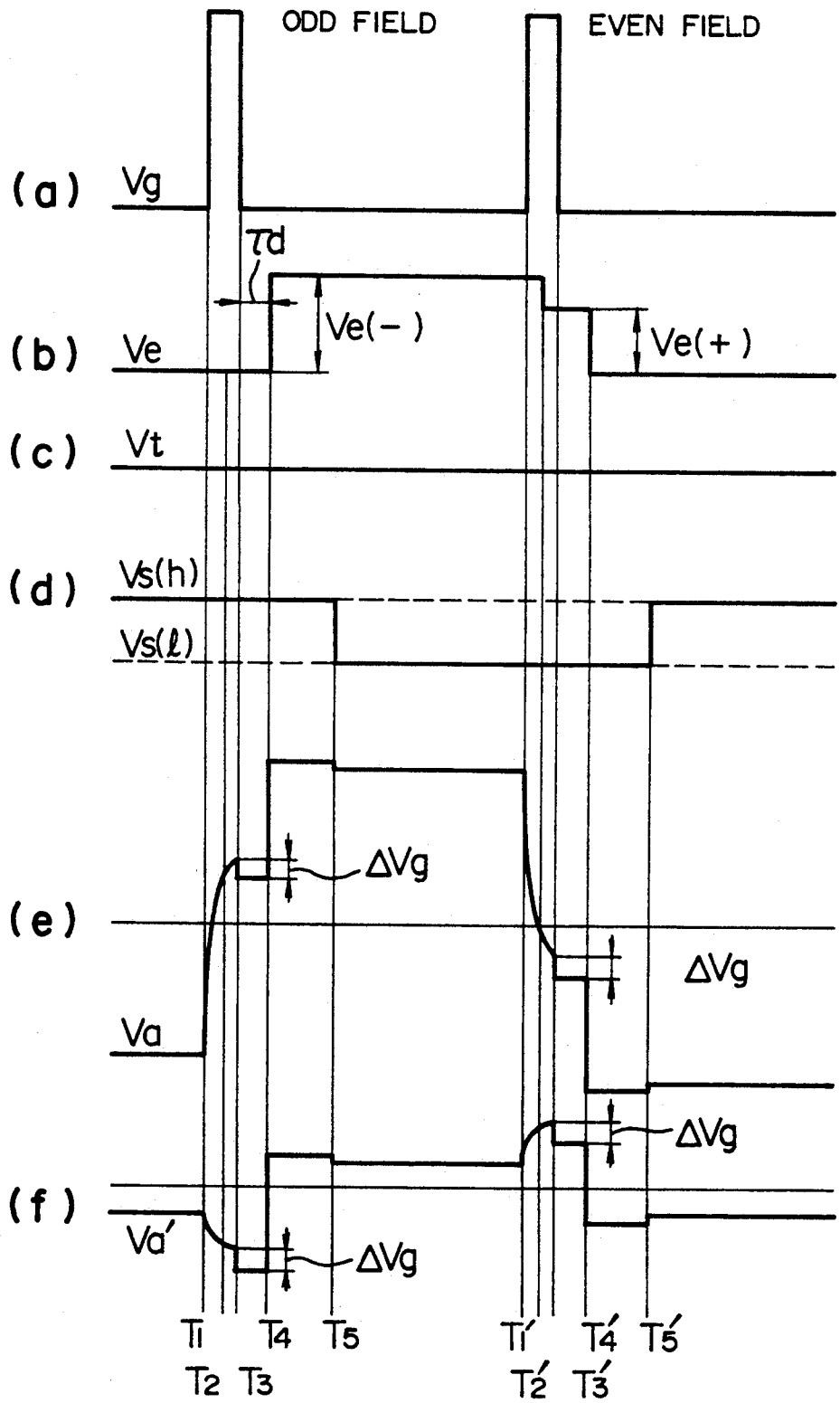

FIG. 4 shows voltage waveforms aiming at improving the drive method shown in FIG. 2, wherein used is a voltage waveform indicated at (b) in FIG. 4 different from that in FIG. 2. The fundamental difference resides in that the voltage of Ve is set at different values between the period from T=T4 to T1' at the odd field and the period from T=T4' to T1 at the even field. Specifically the modulating signal Ve is applied as in the following. The signal Ve is not changed at time T=T2 as indicated by a broken line circle at (b) in FIG. 4, but is changed at T=T4 in the positive direction by the amount Ve(−). The modulating signal is then changed slightly at time T=T2' (within the period while TFT is turned on, or before TFT turns off) and thereafter, at time T=T4' after the completion of scanning by the signal Vg (after TFT turns off), the modulating signal is changed in the negative direction by the amount Ve(+). As appreciated, it is possible to change the potential of the modulating signal during the turning-off period of TFT while satisfying the equation (4).

If the voltage ΔV* of 3.4 V as in FIG. 3 is required upon application of the modulating signal, the modulating signal Ve is changed in the positive direction by the amount of 4.95 V at time T=T4, and in the negative direction by the amount of 2.50 V at time T=T3', respectively in accordance with the equation (4*a*). The voltage difference 2.45 V therebetween is given by changing the potential Ve during the on-period of TFT as shown in FIG. 4.

The invention will now be described more in detail with reference to the preferred embodiments.

1st Embodiment

Figure 5:
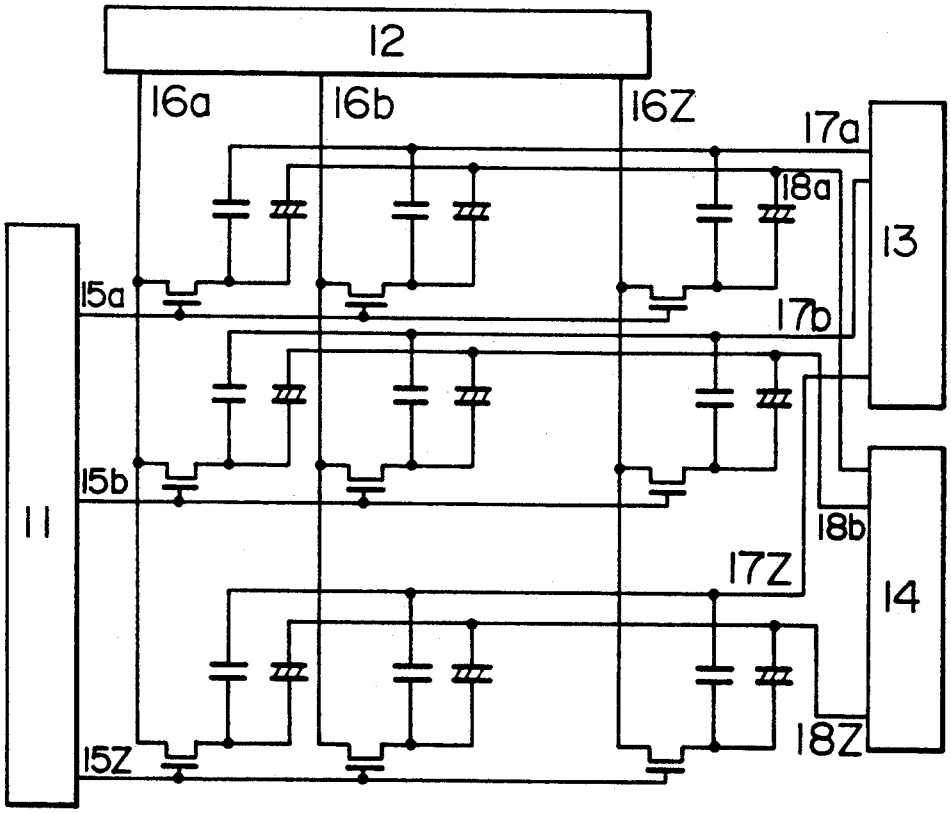
FIG. 5 is a circuit diagram showing the fundamental structure of the display unit according to the first to third embodiments of this invention.

The display unit of the first embodiment of this invention is shown in FIG. 5. Reference numeral 11 designates a scan signal drive circuit, 12 an image signal drive circuit, 13 a first modulating circuit, and 14 a second modulating circuit. 15*a*, 15*b*, . . . , 15*z* designates scan signal lines, 16*a*, 16*b*, . . . , 16*z* image signal lines, 17*a*, 17*b*, . . . , 17*z* common electrodes of storage capacitors Cs, and 18*a*, 18*b*, . . . , 18*z* opposing electrodes of liquid crystals.

Figure 6:
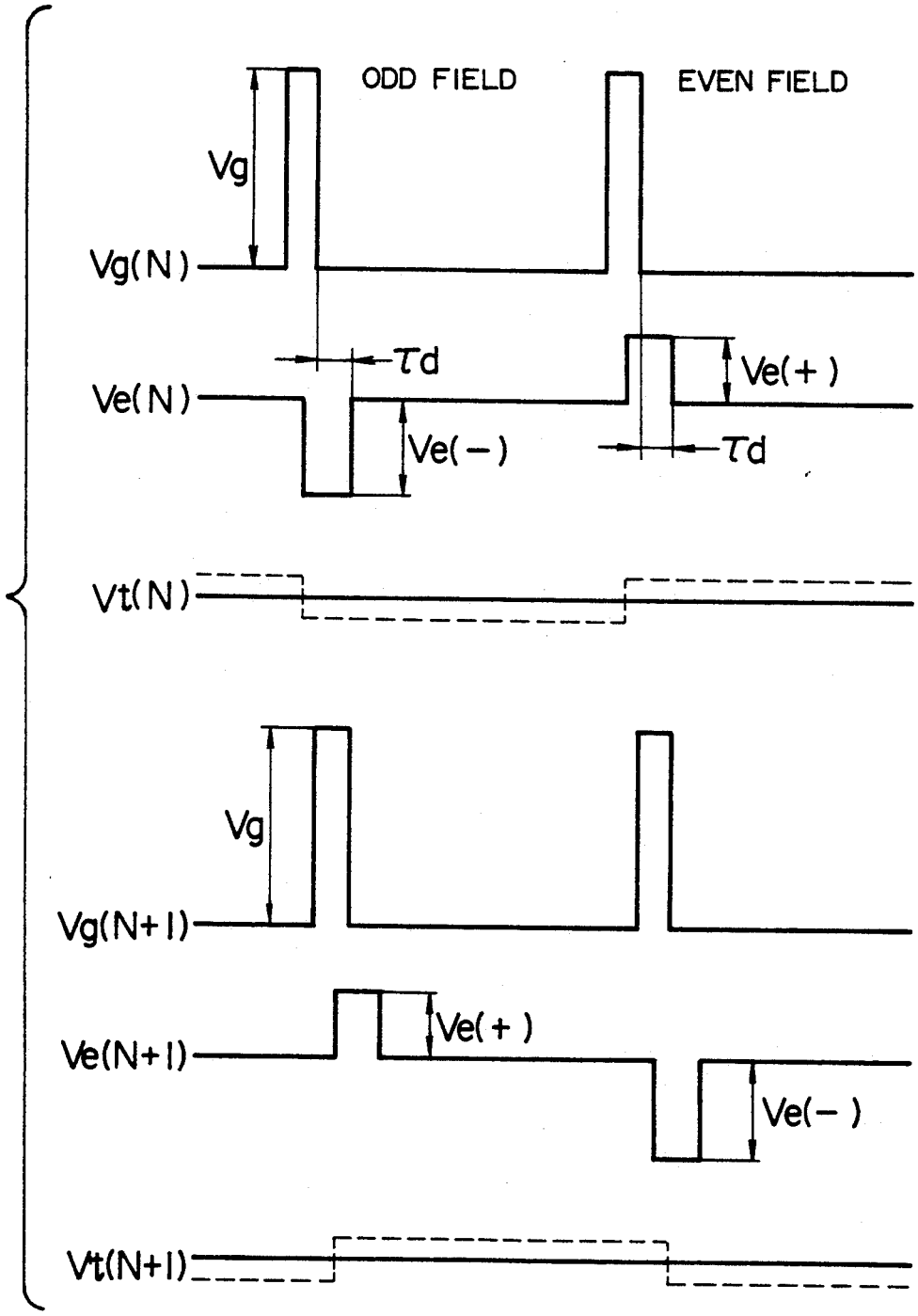
FIG. 6 shows voltage waveforms applied to the display unit of the first embodiment.

In this embodiment, storage capacitors and opposing electrodes are separated at each scan signal line. A modulating signal is applied to the common electrode of the storage capacitors at each scan signal line. The timing chart showing the scan signal and modulating signal is shown in FIG. 6. Shown in this timing chart are scan signals and modulating signals for the N-th and (N+1)-th scan signal lines. The relationship among the modulating signals, ΔV* and Vsig is essentially the same as that shown in FIG. 2. Namely, the polarities of the image signal and modulating signals are reversed alternately for each field.

According to this embodiment, all the range from black to white could be driven by a signal voltage with its amplitude only 3Vpp, while retaining a good display contrast with less flickers. The DC components among respective electrodes were almost zero with a good reliability of the liquid crystal for a long period. The brightness control of a display image was carried out by changing the amplitude of the modulating signal and hence of ΔV*.

2nd Embodiment

Figure 7:
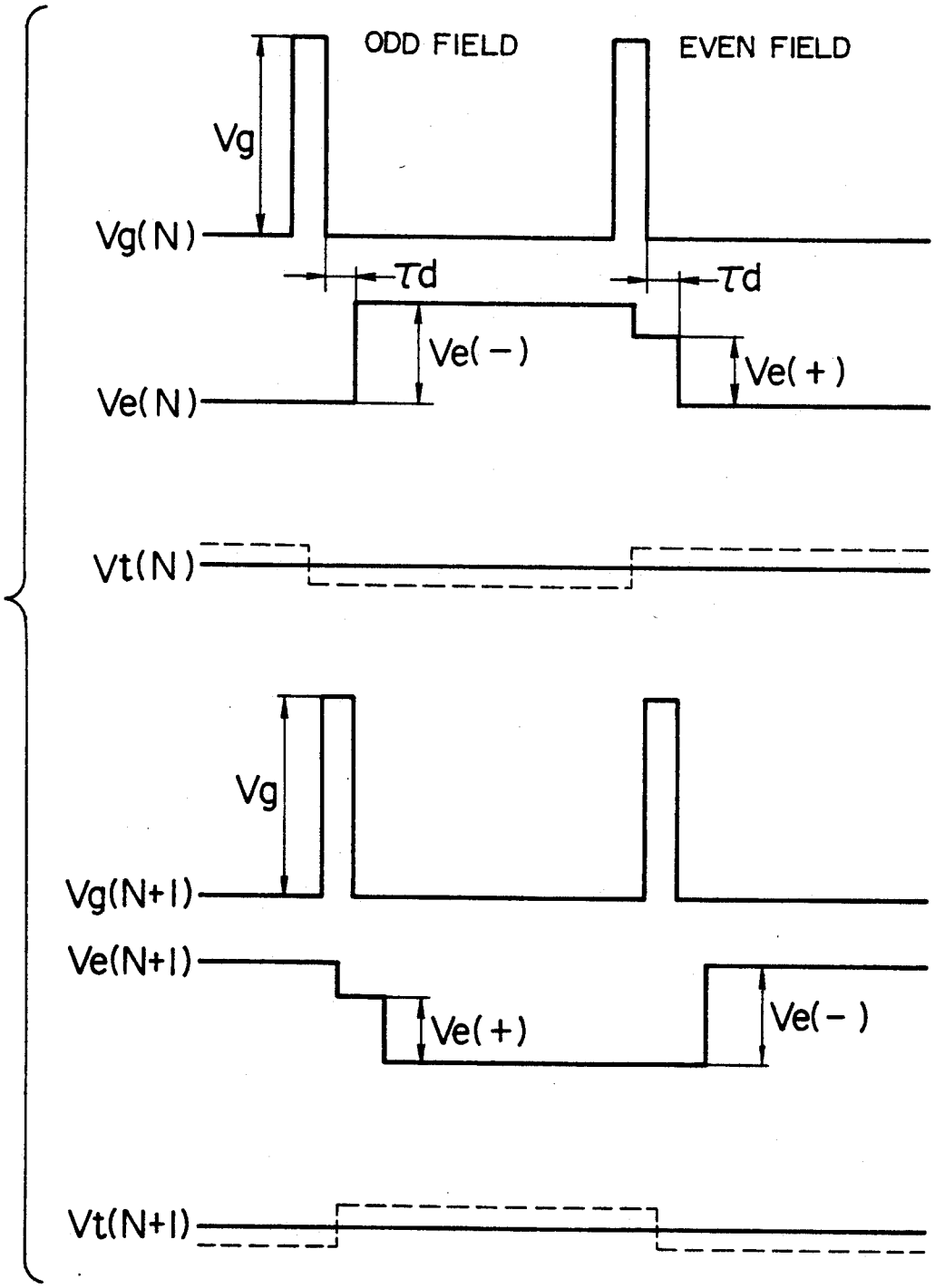
FIG. 7 shows voltage waveforms applied to the display unit of the second embodiment.

In this embodiment, although the same circuit shown in FIG. 5 of the first embodiment is used, a voltage waveform of Ve shown in FIG. 7 is used which is different from that of the first embodiment. The voltage of Ve is different between the even and odd fields. The modulating signals Ve(N) and Ve(N+1) are changed two steps in the negative direction. Specifically, the Ve potential is changed during the on-period of TFT, and after TFT turns off, changed further in the negative direction by the amount smaller than the change in the positive direction.

In addition to the advantages obtained by the first embodiment, this embodiment has another advantage that since the change of Ve in the negative direction during the on-period of TFT is small, the gate voltage necessary for a given image signal voltage is reduced.

3rd Embodiment

In this embodiment, although the same circuit of the first and second embodiments is used and the same voltage waveforms of Vg and Ve are used, the waveform of Vt at each scan line is reversed alternately for each field. The waveform of Vt changes its polarity during the on-period of TFT in the direction opposite to that the waveform Ve changes after the turning-off of TFT. With this arrangement, the modulating voltages Ve(+) and Ve(−) become smaller than those of the first and second embodiments.

4th Embodiment

Figure 8:
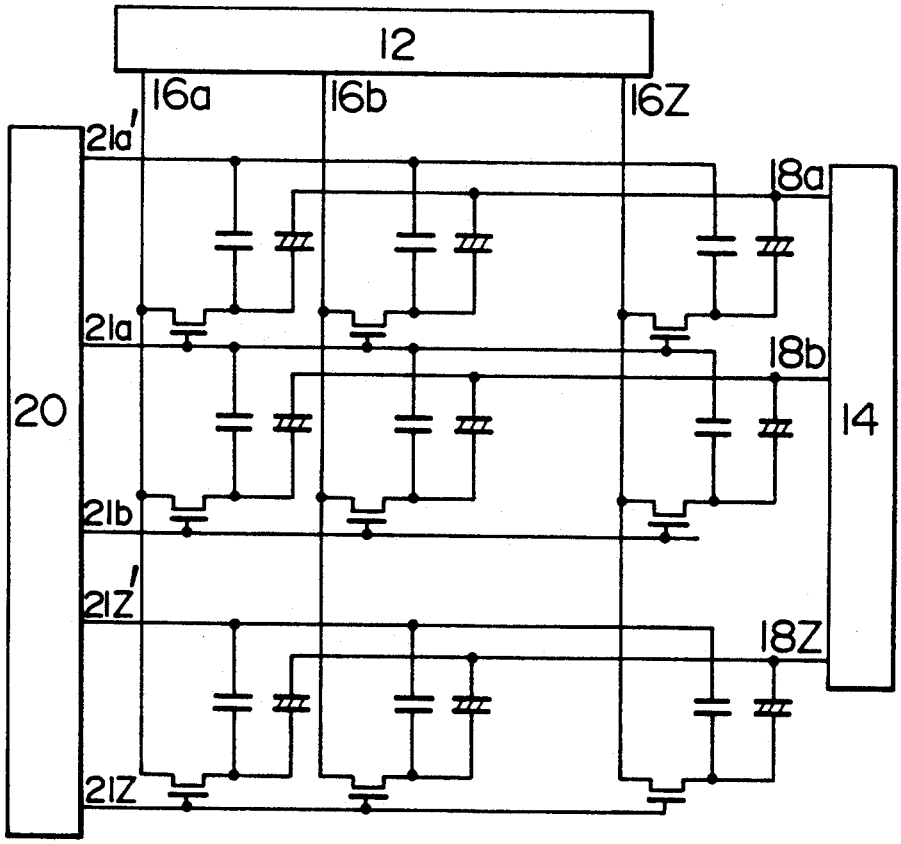
FIG. 8 is a circuit diagram showing the fundamental structure of the display unit according to the fourth embodiment of this invention.
Figure 9:
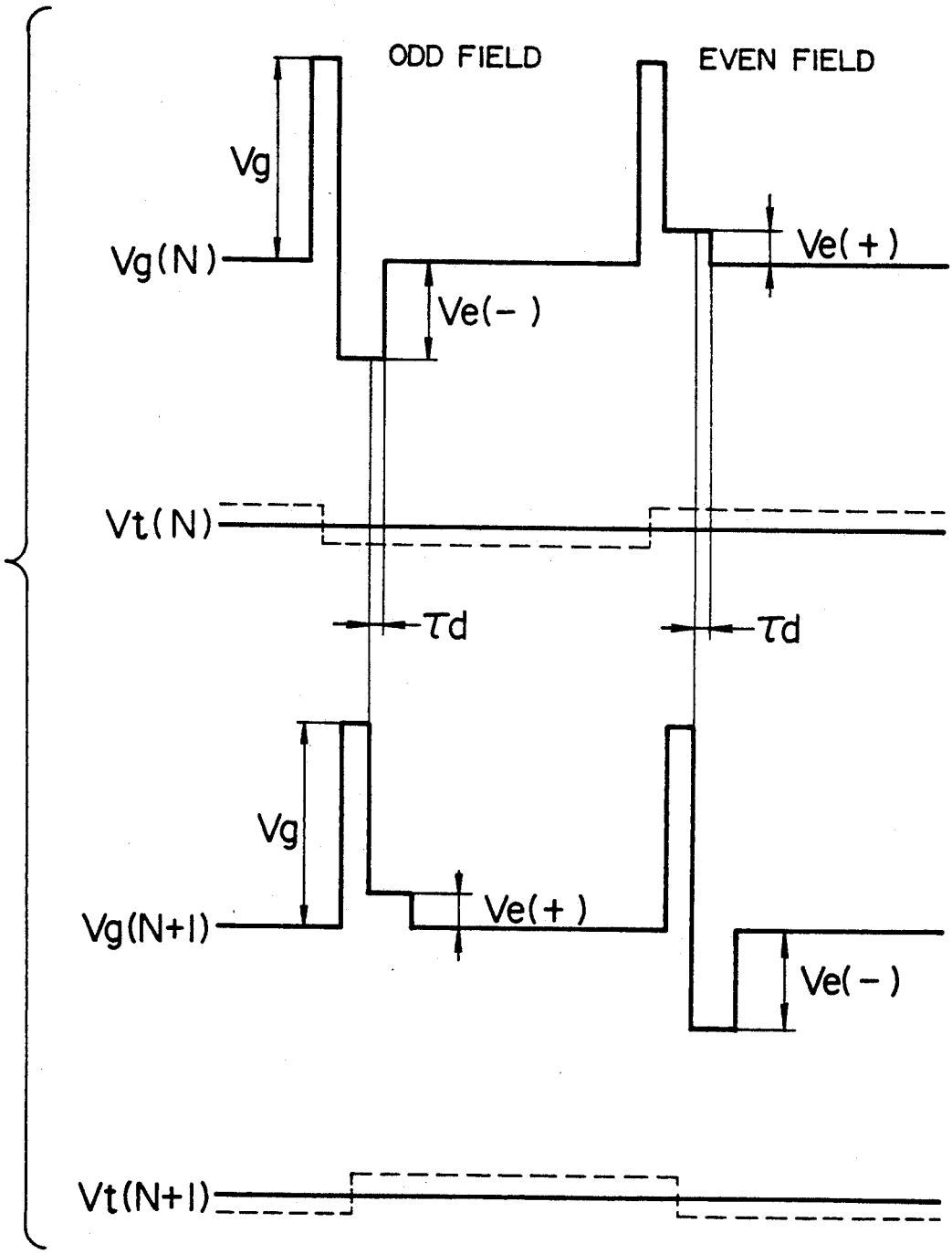
FIG. 9 shows voltage waveforms applied to the display unit of the fourth embodiment.

The circuit of the display unit of the fourth embodiment is shown in FIG. 8 and the voltage waveforms applied to this circuit are shown in FIG. 9. In FIG. 8, reference numeral 21*a* designates a first scan signal line, 21*a'* a common electrode line of storage capacitors at the first scan signal line, 21*z* the last scan signal line, and 21*z'* a scan signal line at the stage before the last stage. This embodiment is different from the first and second embodiments in that the common electrode of storage capacitors is connected to the scan line at the preceding stage. The modulating signal is therefore applied to the preceding stage scan signal line. As shown in FIG. 9, when a delay time $\tau d$ lapses after scanning the (N+1)-th scan signal line, the polarity of the modulating signal applied to the N-th scan signal line is reversed.

The polarity of the modulating signal may be reversed both for the N-th and (N+1)-th scan lines and for the even and odd fields, or only for the even and odd fields. The potential changes of the modulating signal by the amount Ve(+) in the positive direction and by the amount Ve(−) in the negative direction are made variable independently of each other.

The advantages obtained by this embodiment are the same as those of the first embodiment.

5th Embodiment

Figure 10:
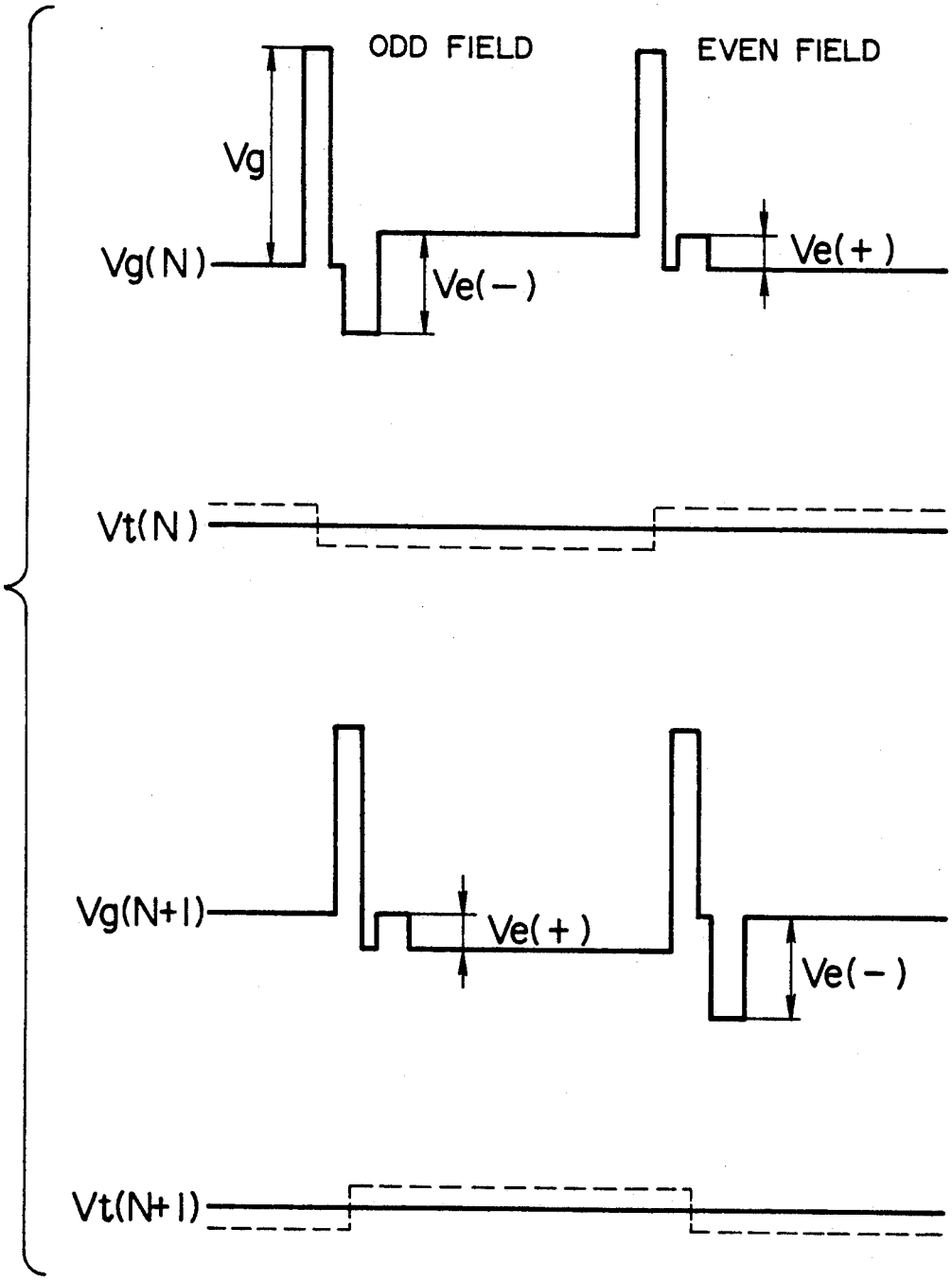
FIG. 10 shows voltage waveforms applied to the display unit of the fifth embodiment.

In this embodiment, the display unit having the same circuit as the fourth embodiment is driven by the signals having the waveforms shown in FIG. 10. In the fourth embodiment, the voltage Vg after modulation is the same for both the even and odd fields, whereas in this embodiment it is different between the even and odd fields. With the waveforms shown in FIG. 10, not only the advantages of the fourth embodiment are obtained, but also the gate amplitude required for driving the gate is made smaller.

6th Embodiment

Figure 11:
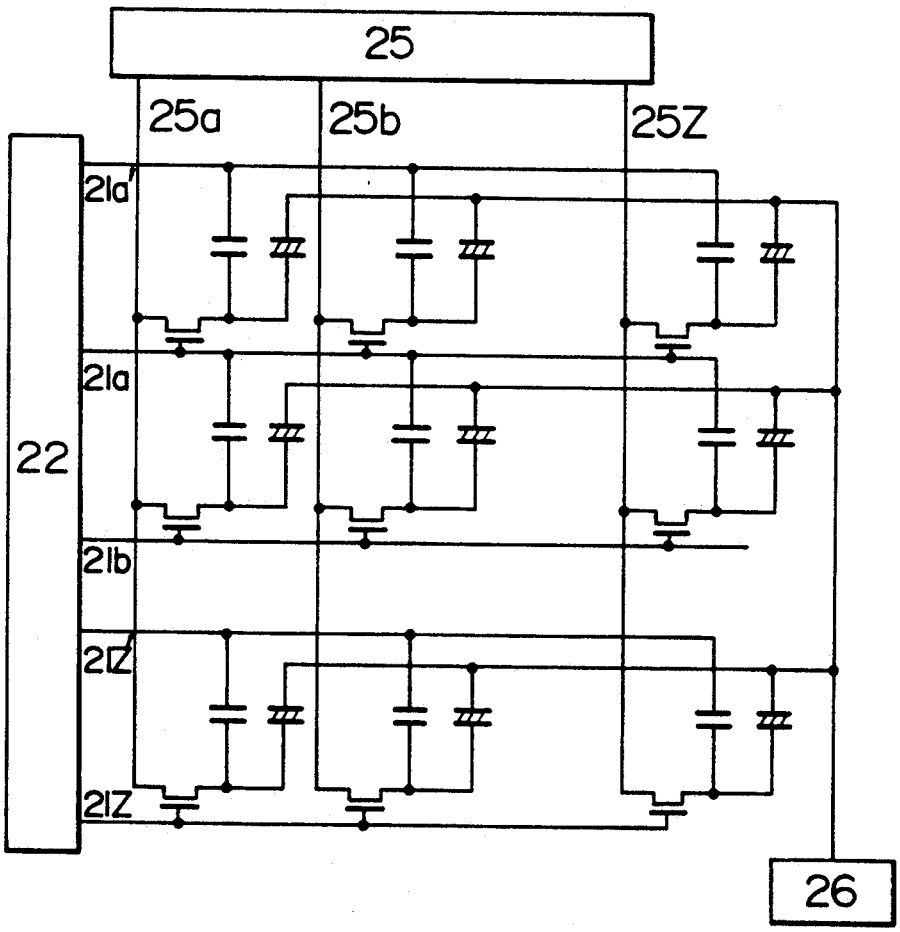
FIG. 11 is a circuit diagram showing the fundamental structure of the display unit according to the sixth embodiment of this invention.

The circuit of the display unit of the sixth embodiment is shown in FIG. 11, and the voltage waveforms applied to this circuit are shown in FIG. 12.

Figure 12A:
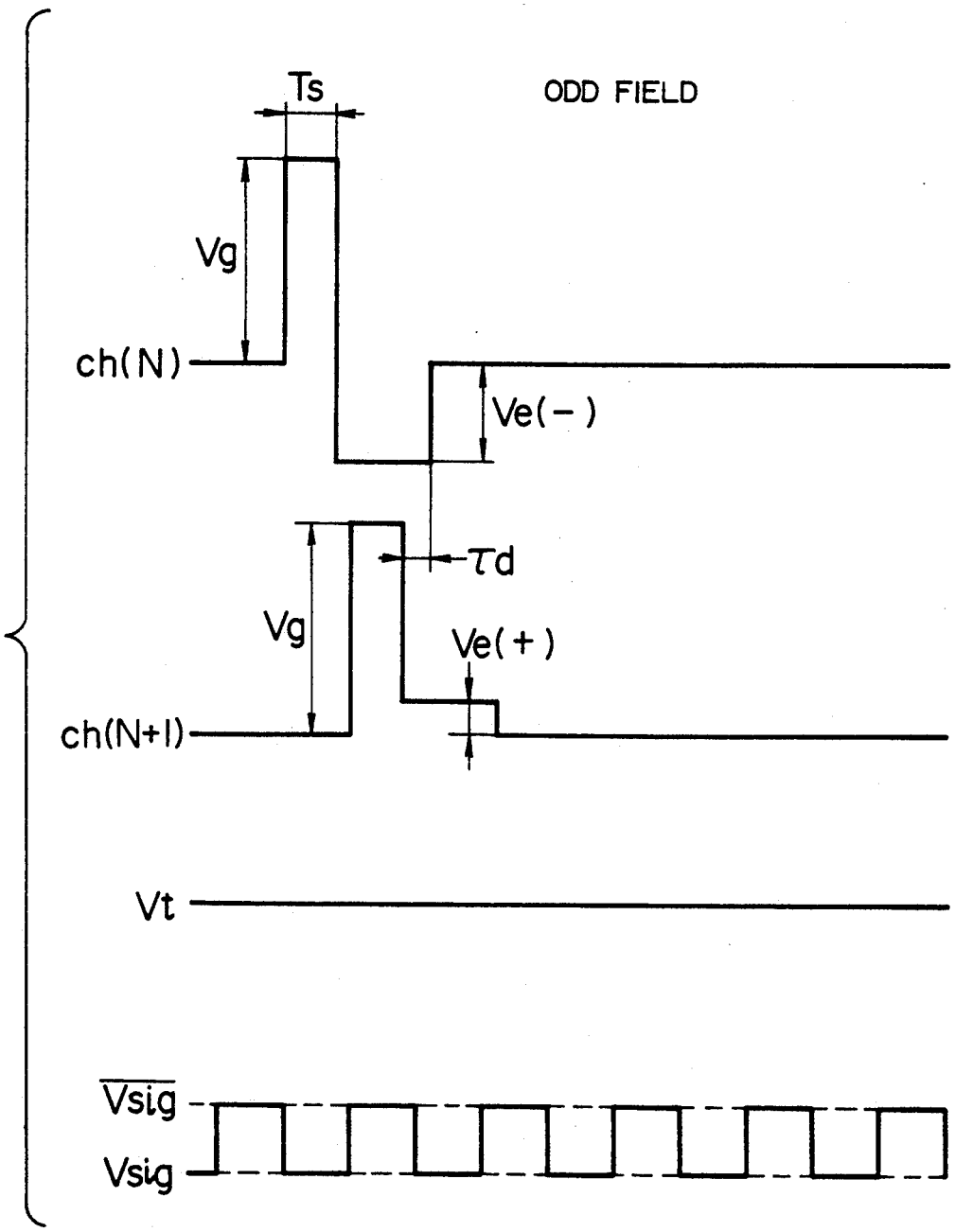
FIG. 12A and 12B shows voltage waveforms applied to the display unit according to the sixth embodiment of this invention.
Figure 12B:
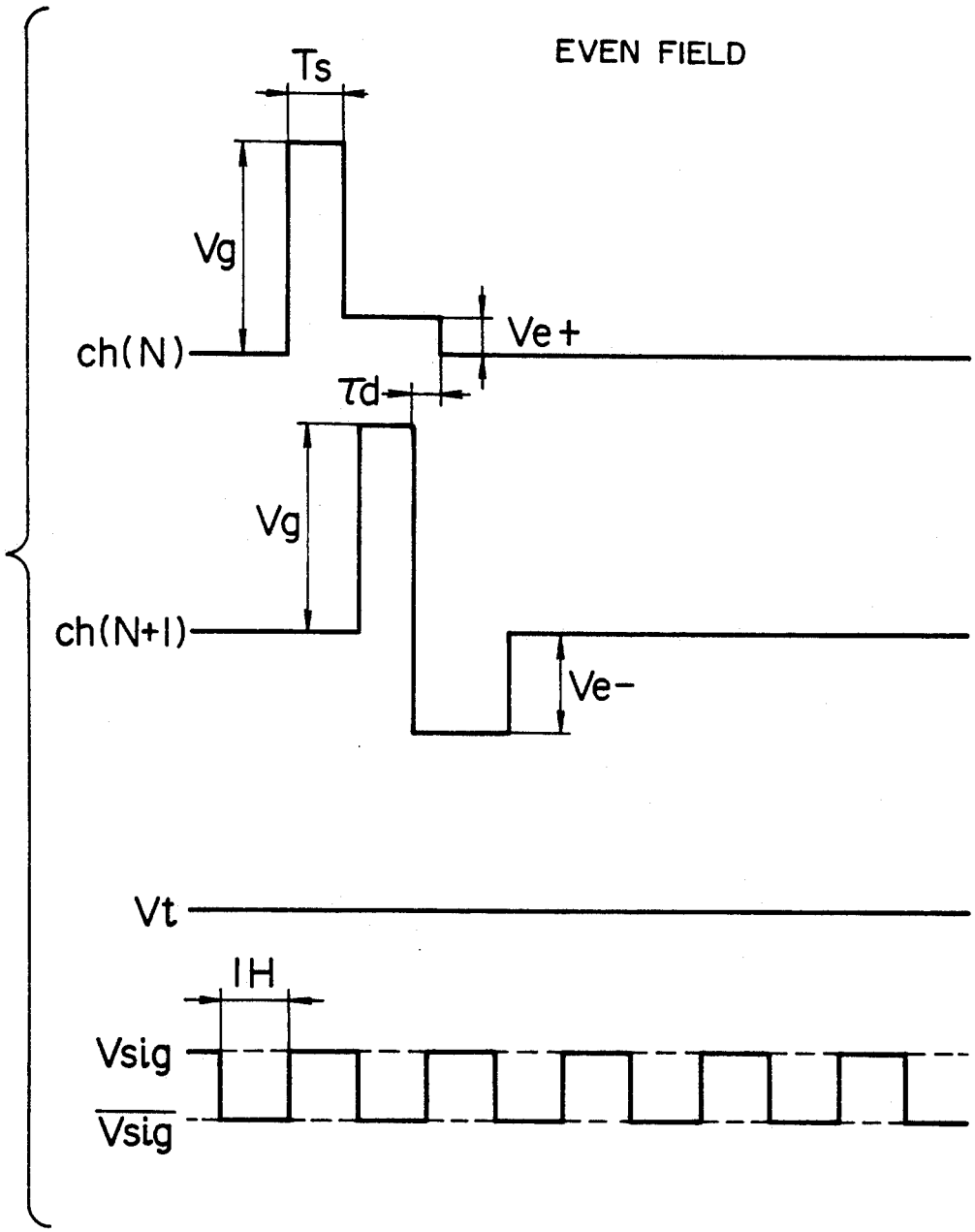

This embodiment is the same as the fourth embodiment in that the modulating signal is applied to the scan signal line, but is different from the already described embodiments in that the opposing electrodes are not grouped into each scan signal line but all the electrodes within the display unit are supplied with a same potential, and in that the polarity of the potential between the pixel electrode and opposing electrode is changed alternately for each one scan period (1 H). In FIG. 11, reference numeral 22 designates a scan signal drive circuit, 25 an image signal drive circuit, and 26 a second modulation signal generating circuit. Reference numerals 25*a*, 25*b*, . . . , 25*z* designate image signal lines. In FIG. 12, Ch(N) and Ch(N+1) represent the voltage waveforms applied to the N-th and (N+1)-th scan signal lines, respectively. Vt represents the opposing electrode potential, and Vsig represents the image signal voltage waveform. The voltage waveforms for AC driving the liquid crystal have their polarities reversed alternately for the even and odd fields, as shown in FIGS. 12A and 12B.

The potentials Ve(+) and VE(−) of the modulating signal immediately after the scan signal Vg in the waveforms Ch(N) and Ch(N+1) are changed independently of each other. The duration Ts of the scan signal Vg is made variable within the period smaller than one scan period. After the lapse of a delay time $\tau d$ after scanning the succeeding stage Ch(N+1) scan line, the modulating signal is applied.

By changing the potentials Ve(+) and Ve(−) of the modulating signal immediately after the scan signal independently of each other, the conditions of the equation (4*a*) can be satisfied.

Also in this embodiment wherein the polarity of the potential at the pixel electrode is changed alternately for each one scan line, it is possible to compensate for the effects of the dielectric anisotropy of liquid crystal and of the DC voltage to be generated between the image signal line and pixel electrode, by adjusting the potentials Ve(+) and Ve(−) (it naturally follows that the average potential of image signals supplied to the image signal line becomes equal to that of pixel electrodes). Consequently, it is possible to remove the main causes of flickers and image memory phenomenon, improve the drive reliability, and reduce the drive power. The gradation controllability is also improved.

Further, since all the opposing electrodes are maintained at the same potential, the number of second modulating signal output lines for the opposing electrodes can be reduced.

Furthermore, since all the potentials of Vsigc of the image signal center voltage, opposing electrode potential Vtc, and Vpc of the pixel center potential can be made equal so that the DC components will become almost zero within the display unit.

The occurrence of the image memory phenomenon was checked by displaying a fixed pattern such as window pattern, color bar, and resolution chart on the display unit and by using the drive method of this embodiment. After displaying a window pattern for four hours, the whole screen of the display unit was set at the halftone display condition. The burning phenomenon of the fixed pattern was not observed.

The image burning phenomenon of two display panels driven in accordance with the conventional method was also checked for comparison therebetween. The first display panel has no storage capacitor for each pixel. With this display panel, the internal DC potential difference between the image signal line and pixel electrode induced by the scan signal via the parasitic capacitor Cgd is 3.5 to 4.0 V. After displaying a window pattern on this display panel for three minutes, the burning phenomenon was clearly observed. Also, after displaying a window pattern on this display panel for one hour, the burning phenomenon did not disappear for three hours. Other fixed patterns also resulted in the same burning phenomenon. The second display panel has a storage capacitor of 1 pF for each pixel, and the internal DC potential difference is 0.7 to 1.0 V. After displaying a fixed pattern for several minutes on this display panel, the burning phenomenon was not observed definitely, but after the one hour consecutive display, it was observed and continued thereafter for several hours.

7th Embodiment

In this embodiment, the voltage waveforms of the fifth embodiment are used while the potential of the second modulating signal generator shown in FIG. 11 is made floated, i.e., while the opposing electrode are not connected to any circuit portion. In this case, the modulating signal Ve applied to the scan signal line is induced, via the internal electrostatic capacitor within the display unit, also to the opposing electrode. The image signal line is held at the potential irrelevant to the modulating signal Ve so that the amplitude of the second demodulating signal appearing at the opposing electrode is in general smaller than Ve, thereby not satisfying the conditional equation (4*b*') correctly. However, the second modulating signal generator can be omitted, resulting in a large reduction of power consumption. An image of good quality can be displayed also in this case, satisfying almost all of the objects of the present invention.

8th Embodiment

In this embodiment, the storage capacitor common lines 17*a*, 17*b*, . . . , 17*z* are connected together and the opposing electrode common lines 18*a*, 18*b*, . . . , 18*z* are connected together in the first embodiment shown in FIG. 5, and the display panel is driven in an analogous way to sixth embodiment which changes the potential polarity of the pixel electrode alternately for each one scan period.

9th Embodiment

Figure 13A:
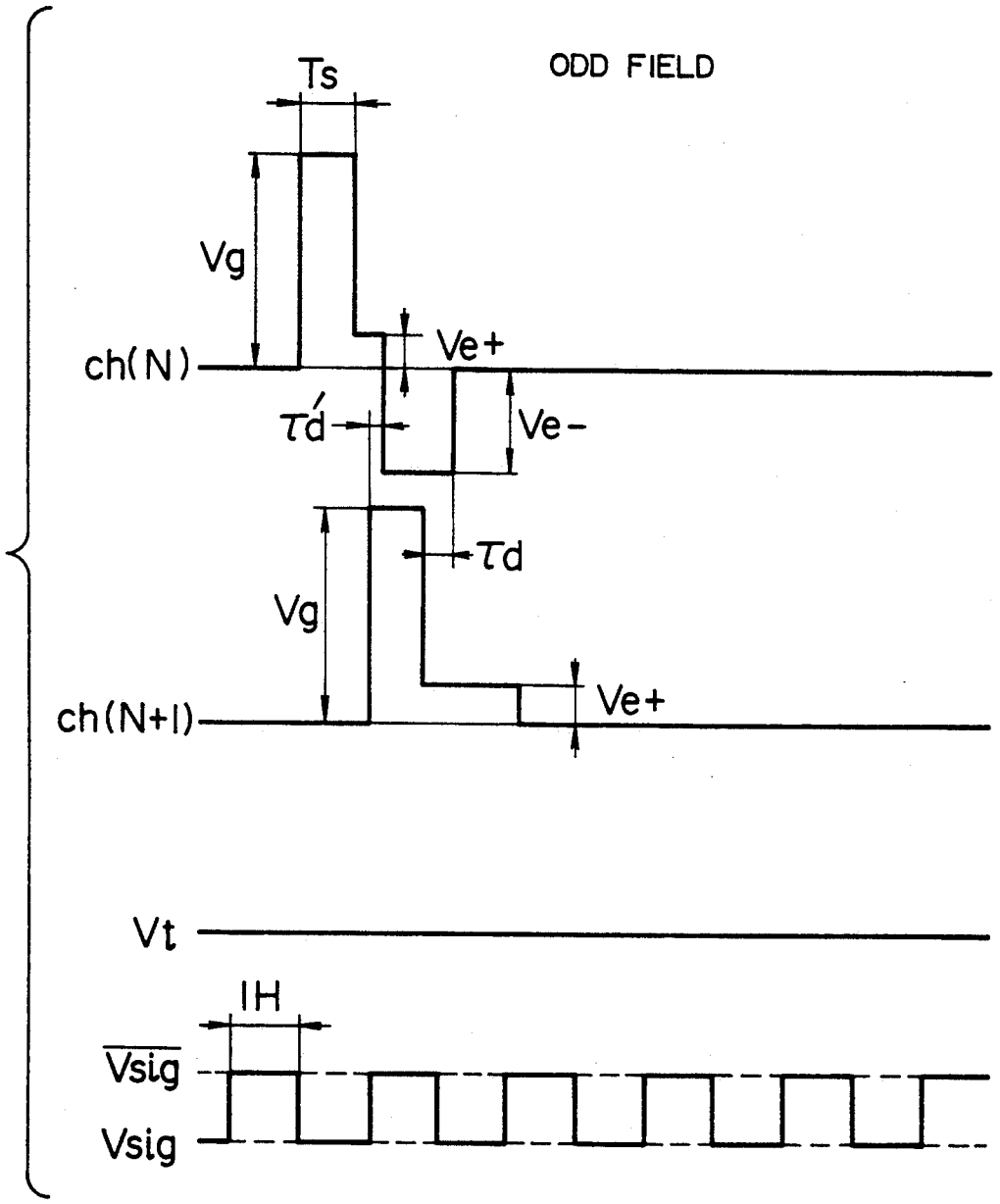
FIG. 13A and 13B shows voltage waveforms applied to the display unit according to the ninth embodiment of this invention.
Figure 13B:
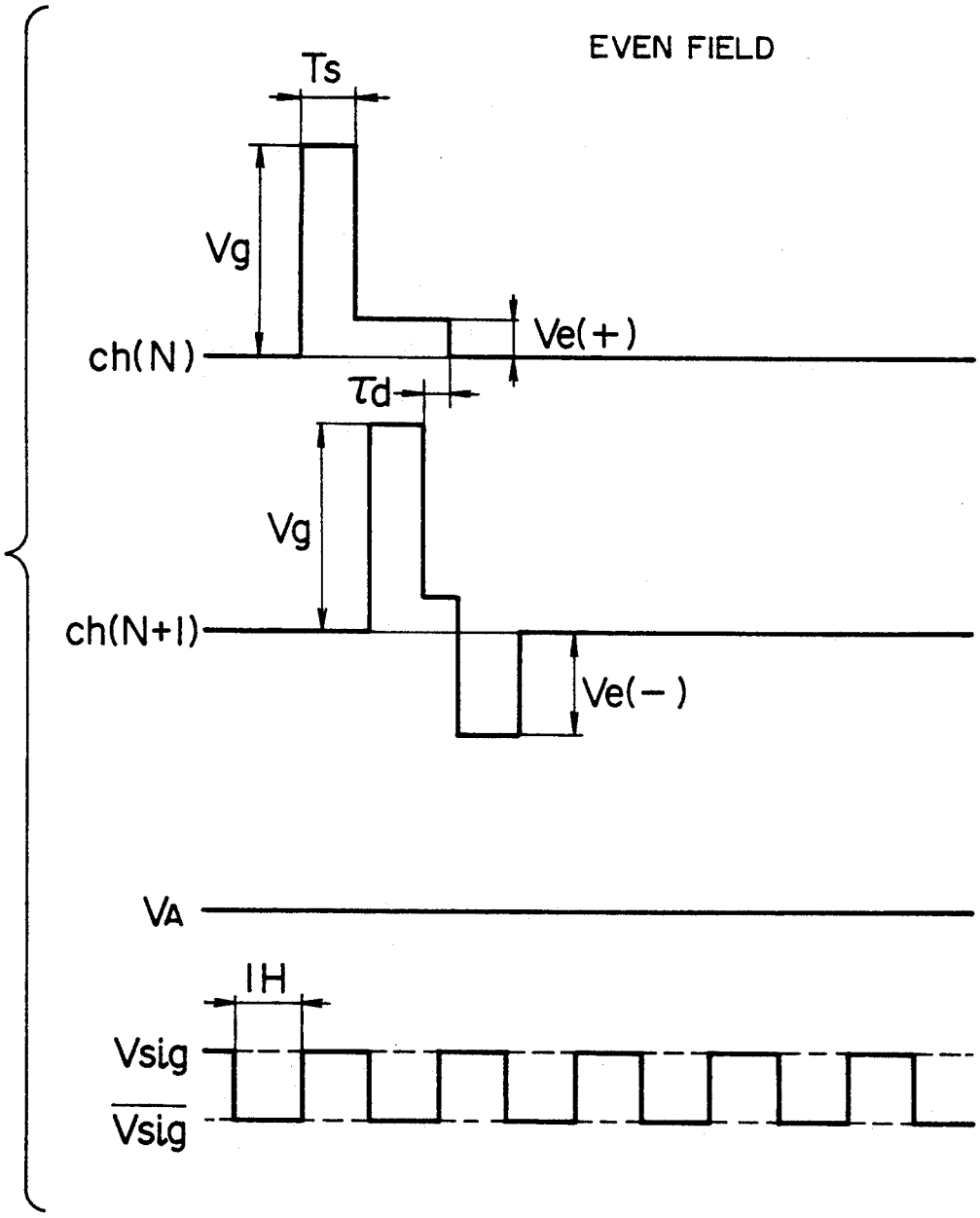

In this embodiment, the circuit shown in FIG. 11 is used and the voltage waveforms shown in FIG. 13 are applied to the display unit. The voltage waveforms Ch(N) and Ch(N+1) shown in FIG. 13 are modifications of those of the sixth embodiment shown in FIG. 12. Specifically, the voltage waveform Ch(N) in the odd field shown in FIG. 13A takes a potential Ve(+) after the on-period Ts of TFT, and after the lapse of a delay time $\tau d'$ ($0 \leqq \tau d' < Ts$) after turning-on of TFT at the succeeding scan line as shown by Ch(N+1), takes a potential Ve(−). In the even field, the voltage waveform Ch(N+1) takes the same waveform as that of Ch(N) in the odd field. With the voltage waveforms shown in FIG. 13, it is possible that the potential change given to the succeeding pixel electrode during the on-period of TFT at the Ch(N) be made the same for both the even and odd fields. Flickers are thereby reduced more than that by the voltage waveforms shown in FIG. 12.

10th Embodiment

Figure 14A:
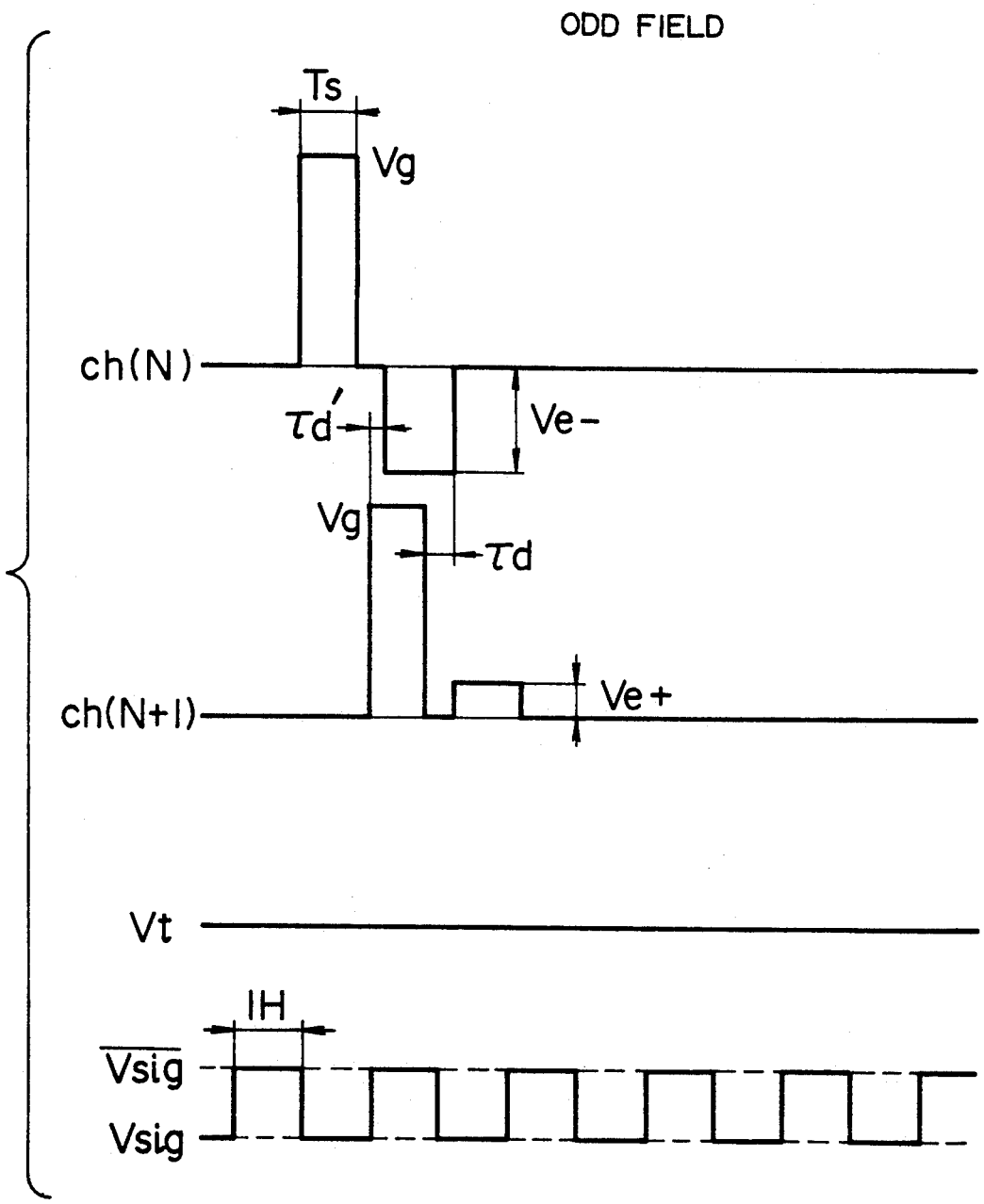
FIG. 14A and 14B shows voltage waveforms applied to the display unit according to the tenth embodiment of this invention.
Figure 14B:
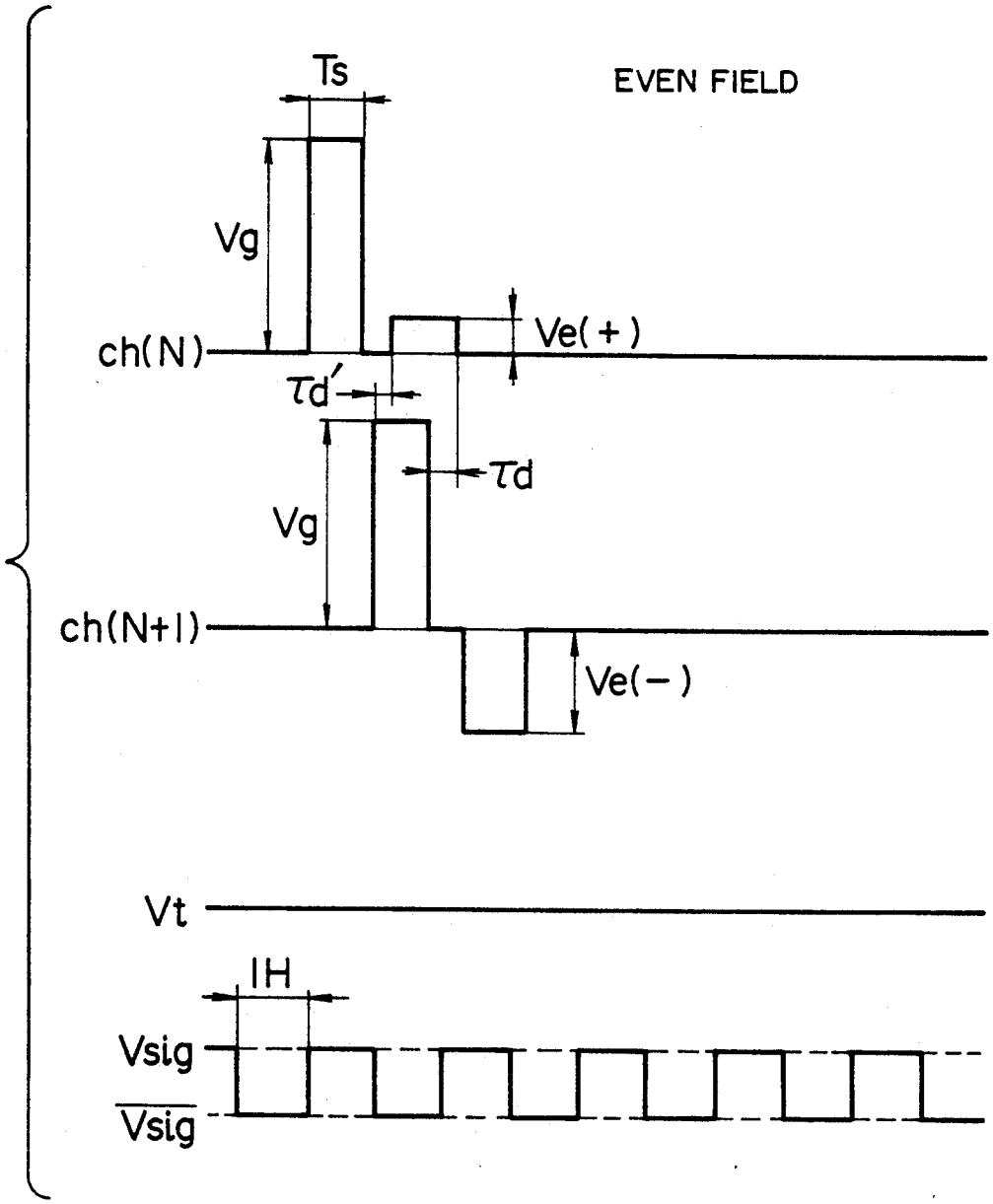

This embodiment uses the circuit shown in FIG. 11 and the applied voltage waveforms shown in FIG. 14 which shows another modification of the voltage waveforms Ch(N) and Ch(N+1) of the sixth embodiment shown in FIG. 12. Specifically, the voltage waveform Ch(N) in the odd field shown in FIG. 14A takes a zero potential after the on-period Ts of TFT, and after the lapse of a delay time $\tau d'$ ($0 \leqq \tau d' < Ts$) after turning-on of TFT at the succeeding scan line as shown by Ch(N+1), takes a potential Ve(−). On the other hand, the voltage waveform Ch(N+1) in the even field takes a zero potential after the on-period of TFT, and after the lapse of a delay time $\tau d'$ ($0 \leqq \tau d' < Ts$) after turning-on of TFT at the succeeding scan line as shown by Ch(N+1), takes a potential Ve(+). Ch(N) in the odd field and Ch(N+1) in the even field are the same voltage waveform, and Ch(N) in the even field and Ch(N+1) in the odd field are the same voltage waveform. With the voltage waveforms shown in FIG. 14, it is possible that the potential change given to the succeeding pixel electrode during the on-period of TFT at the Ch(N) be made the same for both the even and odd field. Flickers are thereby reduced more than that by the voltage waveforms shown in FIG. 12.

The ninth and tenth embodiments are modifications of the sixth embodiment, and the same advantages as the sixth embodiment are obtained by the ninth and tenth embodiments.

As seen from the foregoing description, the present invention has the following distinctive advantages.

First, the amplitude of voltage signals to be generated from the signal drive circuits in an active matrix display unit is considerably lowered, resulting in a reduction of power consumption by the drive circuits which deal with analog signals. Further, in the case of a color display, the amplitude of signals of chroma ICs are lowered to thus reduce power consumption. The drive power for the display unit as a whole can thus be reduced. The lower amplitude of voltage signals makes it easy to fabricate electronic circuitries which nowadays require more and more high integration and high frequency drive signals. In addition, the drive circuit can be operated within the region having a good linearity, thereby allowing a secondary advantage of improving the display quality.

Second, the display quality can be improved. Even in AC driving the display unit alternately for each field as shown in the second and third embodiments, the causes of flickers can be eliminated. With the fourth embodiment, the display brightness can be made uniform and the gradation display performance can be considerably improved.

Third, the reliability of a display unit can be improved, because there is removed the DC voltage conventionally generated unavoidably within the unit due to the anisotropy of liquid crystal, due to capacitive coupling of a scan signal via Cgd, or due to other causes. The DC voltage is the cause of inducing various display defects. By removing the DC voltage, there is less occurrence of the image burning phenomenon which might occur after the display of a fixed pattern. Further, the drive conditions satisfying the equation (4) are not adversely affected by the dielectric anisotropy of liquid crystal. This means that even if the dielectric constant itself changes, e.g., when a display unit is used within a broad temperature region, such change does not influence the operation of the display unit, thereby allowing a stable drive.

In the above description, the present invention has been described using a liquid crystal display unit only by way of example. The present invention is applicable to driving other flat plate type display units.

As can now be appreciated, according to the present invention, it is possible to considerably lower the output voltage signal amplitude of drive circuits for an active matrix display unit, to thereby reduce the power consumption by the drive circuits dealing with analog signals and improve both the image quality and reliability.

We claim:

1. A method of driving a display unit having matrix-arranged pixel electrodes each connected via a capacitor to a first line, each pixel electrode being connected to a switching transistor which is electrically connected to an image signal line and a scan signal line, and liquid crystal material held between said pixel electrode and an opposing electrode and being AC driven, said method comprising the steps of:

transmitting an image signal voltage to said pixel electrode during an on-period of said switching transistor in response to a scanning signal applied to the scan signal line to which a gate of said switching transistor is connected, applying a constant voltage to said opposing electrode, and applying a modulating signal with its voltage level rising and falling from a preceding level alternately only once for each field to said first line during an off-period of said switching transistor after a predetermined delay from a termination of the scanning signal, wherein potential changes $Cs/Ct \cdot Ve(-)$ and $Cs/Ct \cdot Ve(+)$ of said pixel electrode respectively in negative and positive directions caused by the voltage level changes Ve(−) and Ve(+) through said storage capacitor are superposed on a potential change CgdVg/Ct of said pixel electrode caused by the scanning signal Vg through a parasitic capacitance between the gate and a drain of said switching transistor to satisfy the following relationship:

$$CsVe(+)+CgdVg=CsVe(-)-CgdVg,$$

where

Cs is a capacitance of the storage capacitor,

Cgd is the parasitic capacitance between the gate and drain of the switching transistor, Ct is a sum of all capacitances for one pixel, Ve(+) is the potential change of the pixel electrode in the positive direction, Ve(−) is the potential change of the pixel electrode in the negative direction, and Vg is the scanning signal, thereby to enable potentials respectively induced on said pixel electrode in even and odd fields to be equal to each other, thereby to eliminate a DC voltage caused by a capacitance of said liquid crystal material held between the image signal line and the pixel electrode, the image signal line and the opposing electrode and the pixel electrode and the opposing electrode.

2. A method of driving a display unit according to claim 1, wherein the polarity of said image signal voltage transmitted during the on-period of said switching element is reversed alternately for each scan line, and the polarity of said modulating signal applied to said first line during the off-period of said switching element is reversed alternately for each scan line.

3. A method of driving a display unit according to claim 2, wherein the absolute values of Ve(+) and Ve(−) of said modulating signal with its polarity reversed, are different, said modulating signal being applied to said first line during the off-period of said switching element.

4. A method of driving a display unit according to claim 3, wherein a part of the potential of said modulating signal is changed before the end of the off-period of said switching element.

5. A method of driving a display unit according to claim 3, wherein said switching element is a thin film transistor (TFT) and a relationship between Ve(+) and Ve(−) of said modulating signal with its polarity reversing alternately for each scan line and a scan signal voltage Vg is given by:

$$CsVe(+)+CgdVg=CsVe(-)-CgdVg$$

where Cs is a storage capacitor, Cgd is a gate-drain capacitor and Csd is a source-drain capacitor of said thin film transistor.

6. A method of driving a display unit according to claim 1, wherein the potential of said opposing electrode of the liquid crystal display unit remains constant at least during each field period.

7. A method of driving a display unit according to claim 1, wherein the potential of said opposing electrode of the liquid crystal display unit is constant and equal to the average center potential of said image signal voltages.

8. A method of driving a display unit according to claim 5, wherein the potential of said opposing electrode is electrically floated.

9. A method of driving a display unit according to claim 1, wherein said first line is used in common with said scan signal line, and said modulating signal is applied to said scan signal line superposing upon said scan signal.

10. A method of driving a display unit according to claim 1, wherein the average DC voltage among said opposing electrode, image signal line and pixel electrode is smaller than $CgdVg/\Sigma C$, where $\Sigma C$ is the total electrostatic capacitance per one pixel.

11. A method of driving a display unit according to claim 1, wherein Ve(+) and Ve(−) of said modulating signal voltage are set so as to satisfy the following formula:

$$Vth \leqq \Delta V^* \leqq Vmax$$

where $\Delta V^*$ is expressed by:

$$\Delta V^*=(Ve(+)+Ve(-))\ Cs/2Ct$$

$$Ct=Cs+Cgd+Csd+Clc$$

where the voltage range within which the transmission factor of a liquid crystal changes is from Vth to Vmax, Cs is the storage capacitor, Cgd is a gate-drain capacitor, Csd is a source-drain capacitor, and Clc is the liquid crystal capacitor.

12. A method of driving a display unit according to claim 10, wherein $\Delta V^*$ is set so as to satisfy the following equation:

$$\Delta V^*=(Vmax+Vth)/2$$

13. A method of driving a display unit according to claim 2, wherein the potential of said opposing electrode of the liquid crystal display unit remains constant at least during each field period.

14. A method of driving a display unit according to claim 2, wherein the potential of said opposing electrode of the liquid crystal display unit is constant and equal to the average center potential of said image signal voltages.

* * * * *